US005631726A

United States Patent [19]

Sawada

[11] Patent Number: 5,631,726

[45] Date of Patent: May 20, 1997

[54] PRINTER DEVICE WITH QUIET OPERATION STRUCTURE

[75] Inventor: Kenji Sawada, Toyokawa, Japan

[73] Assignee: Minolta Co., Ltd., Osaka, Japan

[21] Appl. No.: 423,203

[22] Filed: Apr. 17, 1995

[30] Foreign Application Priority Data

May 16, 1994 [JP] Japan ..... 6-101030

[51] Int. Cl.[6] ..... G03G 15/00

[52] U.S. Cl. ..... 399/111; 399/167

[58] Field of Search ..... 355/200, 210, 355/211, 245, 260

[56] References Cited

U.S. PATENT DOCUMENTS

| | | | |
|---|---|---|---|
| 4,967,239 | 10/1990 | Sakakura | 355/211 X |
| 5,047,803 | 9/1991 | Kanoto | 355/211 |
| 5,291,242 | 3/1994 | Takano | 355/200 |
| 5,298,941 | 3/1994 | Tenpaku | 355/200 |
| 5,323,213 | 6/1994 | Ahn | 355/210 |
| 5,331,378 | 7/1994 | Baker et al. | 355/210 |

*Primary Examiner*—Sandra L. Brase

*Attorney, Agent, or Firm*—Brinks Hofer Gilson & Lione

[57] ABSTRACT

An image forming device has a device body, an imaging cartridge removably installable within the device body and having a driven element, such as a photosensitive member or a developing unit, and a driven gear which transmits a drive force to the driven element, a plurality of intermediate gears provided in the device body, at least one of the plurality of intermediate gears meshing with the driven gear to drive the driven gear, a drive gear positioned in the device body to drive the at least one intermediate gear, a frame member provided inside the device body, and a cover member provided inside the device body and attached to the frame member to define a confined space region between the cover member and the frame member, at least the drive gear being disposed in the confined space region. By enclosing at least the drive gear in an enclosed space region in the body of the image forming device, the device is effectively enabled for substantially silent operation.

28 Claims, 12 Drawing Sheets

Fig. 11A
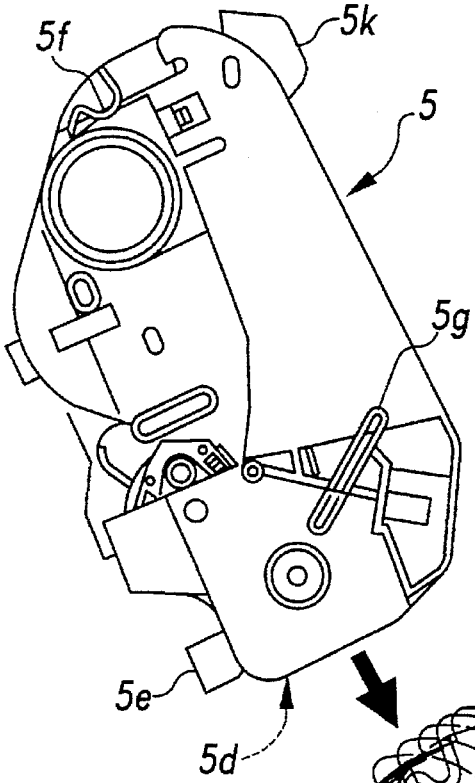
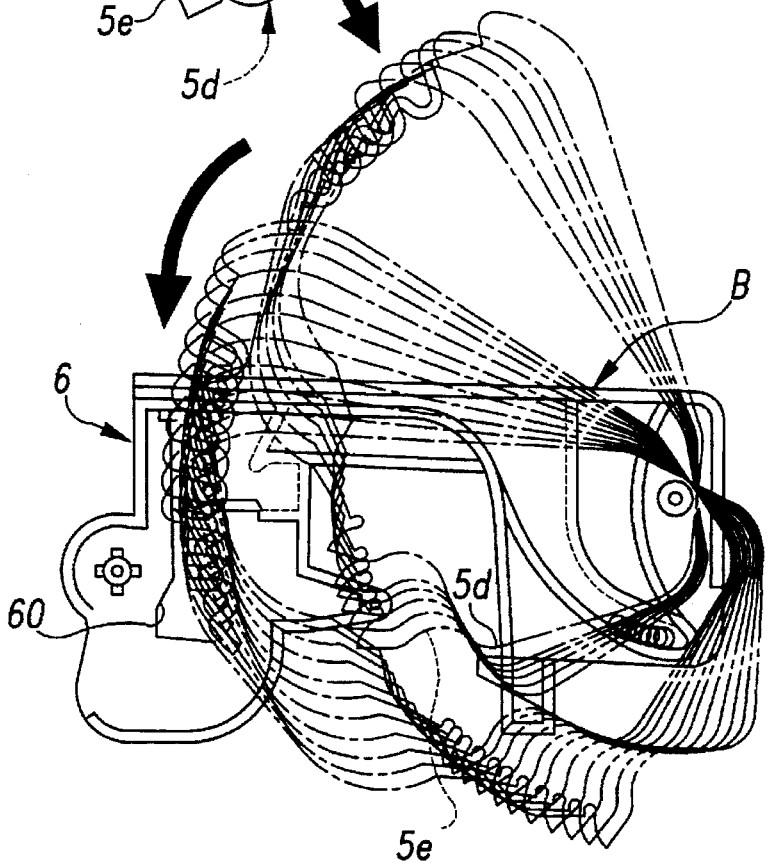
Fig. 11B

PRINTER DEVICE WITH QUIET OPERATION STRUCTURE

FIELD OF THE INVENTION

The present invention relates generally to printer devices; and, more particularly, to improvements in the drive system of a printer device for forming images by the electrostatic copying process.

DESCRIPTION OF THE PRIOR ART

With the prevalent use of printers in recent years, manufacturers have reached comparable levels with respect to techniques regarding the main function of the printer, i.e., the printing function. Competitive market pressures, however, have created a great need for improvements in the drive system, in printed images and in various other components of the printer in order to provide a quieter operation and to more effectively release heat at a reduced cost.

To meet the needs of the marketplace, attempts have been made by manufacturers to improve the drive train of printers by developing gear shaft configurations and gear train arrangements which are less likely to affect the main function of the device, and which provide the manufacturer with substantial freedom in modifying the overall design of the printer so as to permit desired improvements to be made.

In addition, in view of the fact that resin materials have become readily available at a relatively low cost, there is an increasing tendency to use such materials in the drive trains of printers.

In particular, it has become conventional to manufacture gears and the like used in printers from nylon in order to reduce meshing noises due to gear backlashing and to help provide a quieter operation.

Furthermore, it has become the practice that heat generated in the device by the drive motor or the like is allowed to escape through a window aperture optionally formed in the housing of the printer.

However, conventional printer devices as described above have the problem that since the drive train is generally provided in a non-confined state within the body of the printer for the convenience of assembling and maintenance, it is impossible to prevent the drive train from giving off bothersome noise.

The object of the present invention, therefore, is to provide a printer device which is effectively adapted for substantially silent operation.

SUMMARY OF THE INVENTION

In order to achieve the above objective, the present invention provides an image forming device which comprises a device body, an imaging cartridge removably installable within the device body and having a driven element such as a photosensitive member or a developing unit, and a driven gear which transmits a drive force to the driven element, a plurality of intermediate gears provided inside the device body, at least one of the plurality of intermediate gears meshing with the driven gear to drive the driven gear; a drive gear provided inside the device body to drive the at least one intermediate gear, a frame member provided inside the device body, and a cover member provided inside the device body and attached to the frame member to define a confined space region between the cover member and the frame member, the drive gear being disposed in the confined space region.

An image forming device according to the present invention provides a confined space region within the body of the image forming device and within which at least the drive gear of the drive train of the device is positioned. By enclosing at least the drive gear in a confined space region, noise produced by the operation of the drive gear is prevented from escaping to the outside of the region and to the outside of the body of the device, thus effectively providing the device with a substantially silent operation.

Preferably, a plurality of intermediate gears of the drive train are also positioned in the confined space region for further silencing the operation of the drive train.

According to a presently preferred embodiment, the confined space region is formed between a side plate frame provided internally of a side wall of the device and a drive cover disposed inwardly of the side plate frame, and the various gears and gear shafts of the drive train are supported in the region therebetween.

According to a further aspect of the invention, the cover member is formed of a resin material, and the gear shafts which support the plurality of gears are integral with the cover member and have an axial bore extending therethrough to assist in dissipating heat generated in the device to the outside of the device body.

Further details and advantages of the present invention will become apparent hereinafter in connection with the following detailed description thereof.

BRIEF DESCRIPTION OF THE DRAWINGS

FIG. 11 is a side elevation schematically showing a path of insertion of the imaging cartridge into the printer device of FIG. 1 as seen from the left side thereof;

DETAILED DESCRIPTION OF THE PREFERRED EMBODIMENT

Figure 1:
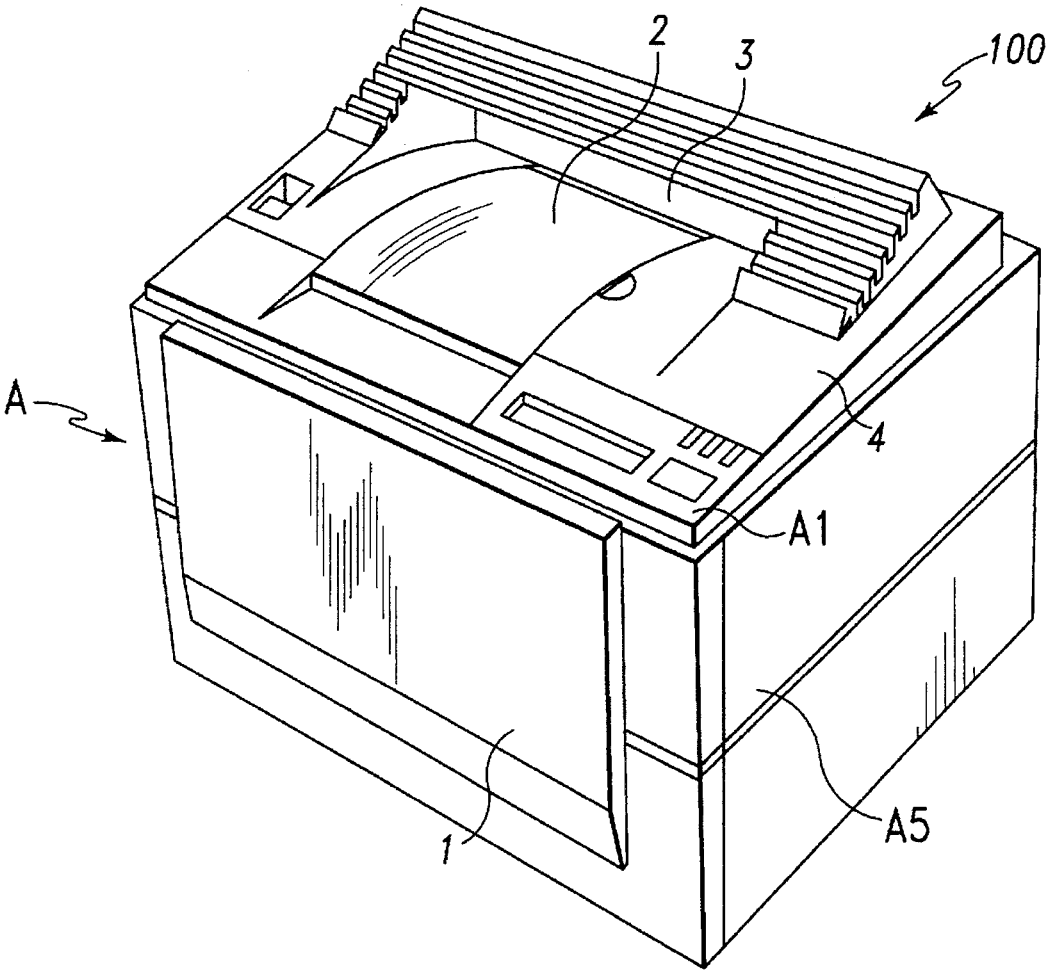
FIG. 1 is a perspective view illustrating a printer device according to a presently preferred embodiment of the invention.
Figure 2:
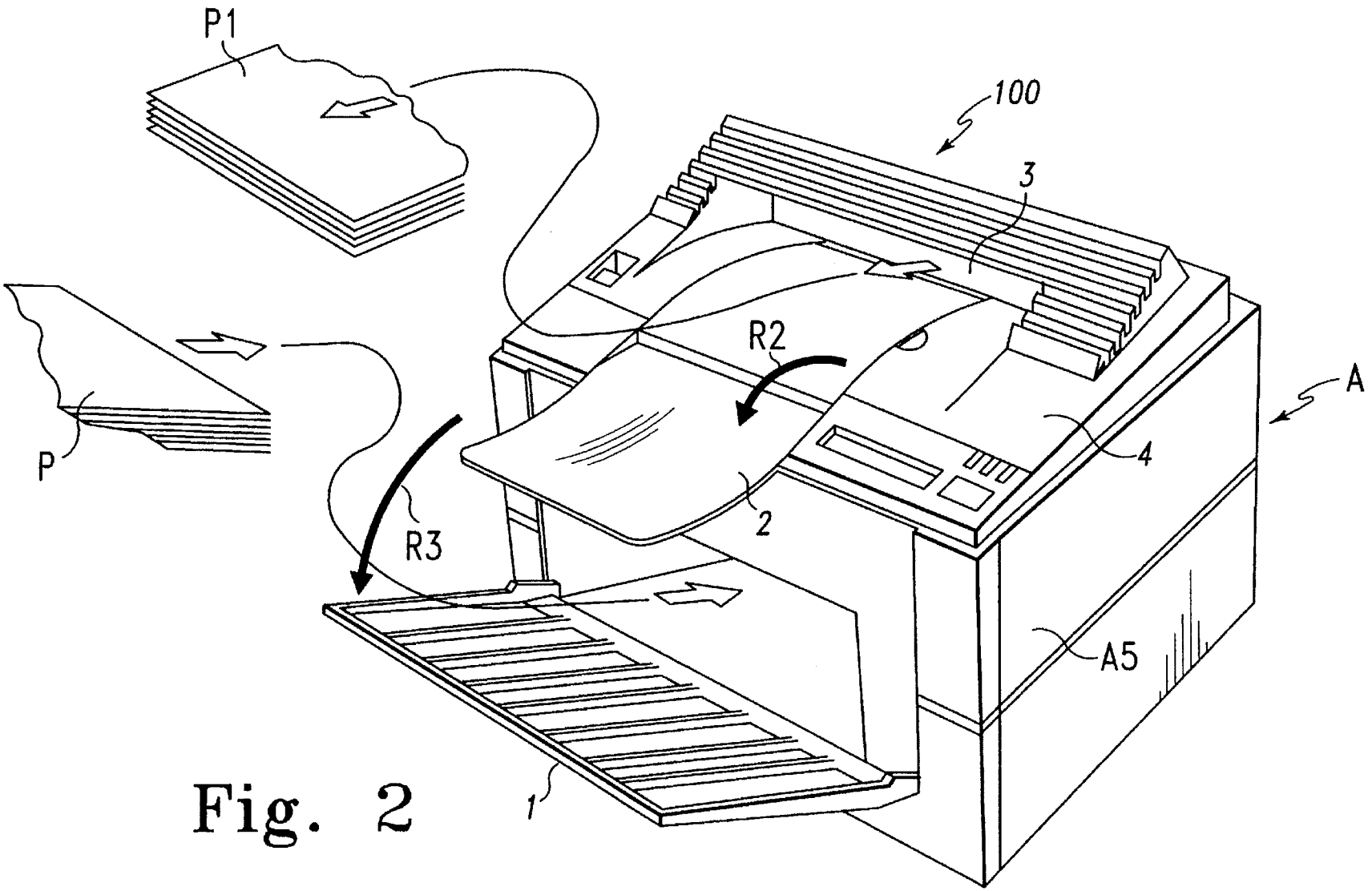
FIG. 2 is a perspective view schematically illustrating the manner in which the printer device of FIG. 1 is used.
Figure 3:
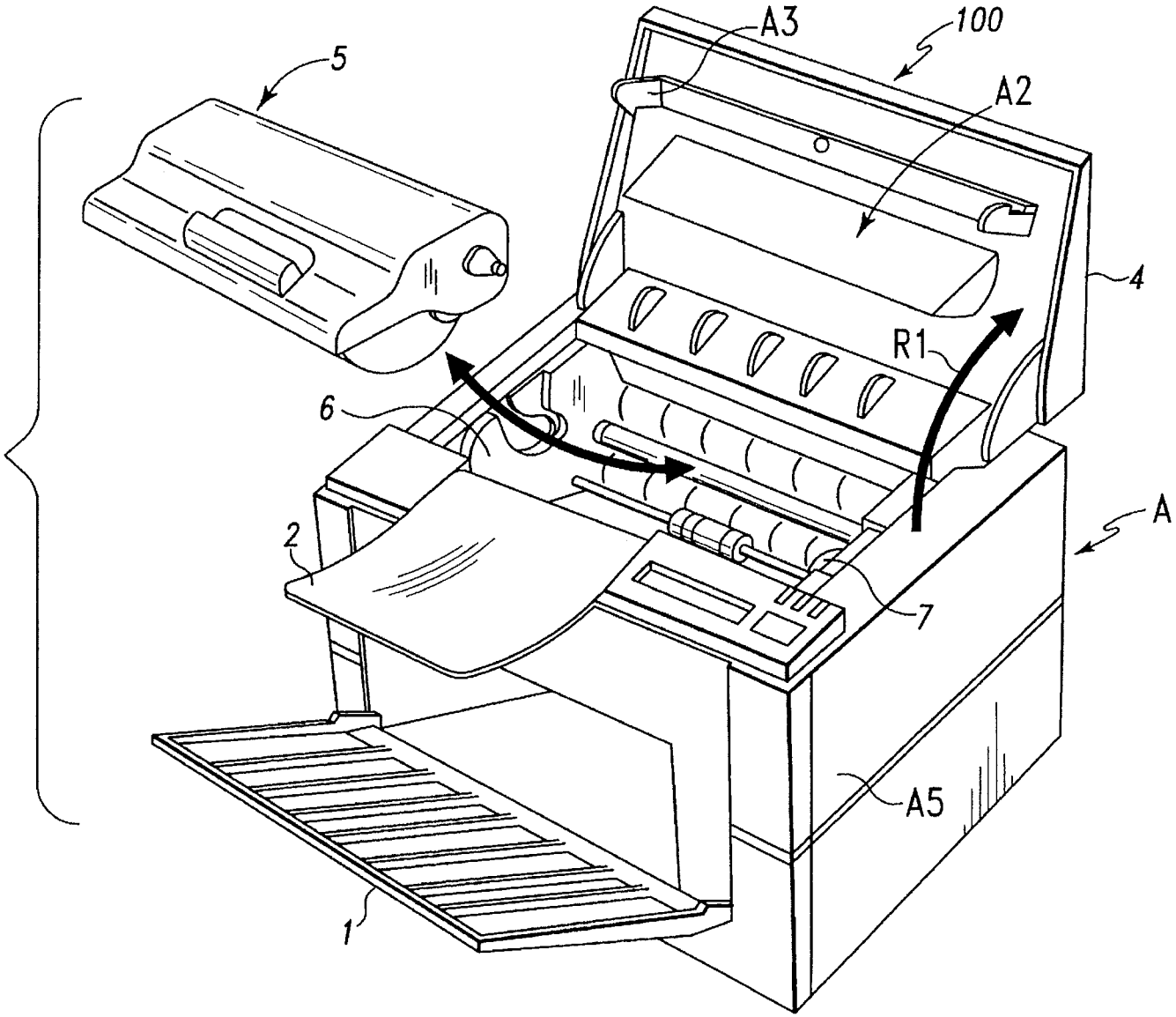
FIG. 3 is a perspective view of the printer device of FIG. 1 with an imaging cartridge thereof removed from the device.

FIGS. 1–3 illustrate a printer device according to a presently preferred embodiment of the invention. The printer device is generally designated by reference No. 100, and includes a device body A which is generally in the form of a box.

Device body A is provided with a pivotally openable upper cover 4 having a paper outlet 3, and an operation panel A1 for setting a print mode, the number of prints, etc. The upper cover 4, when opened in the direction of arrow R1 in FIG. 3, permits a user to install an imaging cartridge 5 (hereinafter referred to as an "I/C 5") into or remove the I/C 5 from the printer device, as shown in FIG. 3, and to perform various maintenance activities on the device such as clearing a paper jam and the like.

A lock hook A3 is provided on the lower side of the upper cover 4 for preventing the cover 4 from inadvertently opening.

Provided on a front portion of the upper side of the upper cover 4 is a paper discharge tray 2. Paper discharge tray 2 is opposed to the paper outlet 3 and is pivotally openable in the direction of arrow R2 in FIG. 2. When opened, discharge tray 2 is adapted to receive paper P1 discharged from the paper outlet 3 as shown in FIG. 2.

Device body A also includes a front vertical wall which is provided with a front cover 1 pivotally openable in the direction of arrow R3 in FIG. 2. When opened, the front cover 1 serves as a feed tray for feeding paper P as schematically illustrated in FIG. 2.

Figure 4:
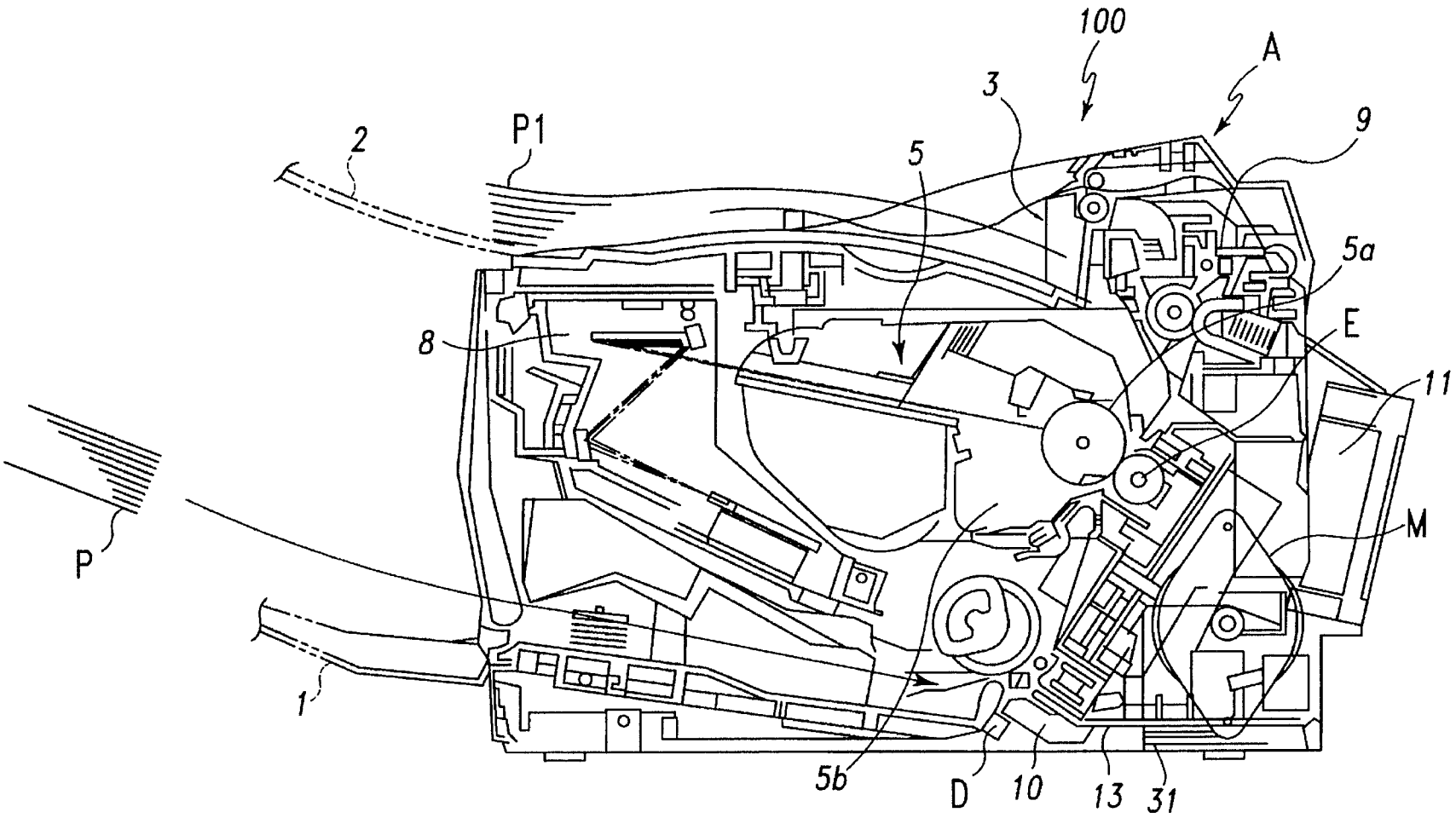
FIG. 4 is a sectional, side view illustrating the interior of the printer device of FIG. 1.

With reference to FIG. 4, a feed station D including a feed roller is provided inside the device body A of printer device 100 on a transport base plate 10. Feed station D is located to the rear of the feed tray (front cover 1 ) at the front lower portion of the device body A. Arranged to the rear of the feed station D are a high-voltage board 13 serving as a power source and a low-voltage board serving as a controller 31. The device 100 is also provided on its rear side with a cooling fan 11 having an exhaust opening formed in the rear outer wall of device body A (also see FIG. 10).

The I/C 5 is positioned in place in device body A obliquely and forwardly above the above-described components as shown in FIG. 4. Opposed to and in front of the I/C 5 is an optical head 8 incorporating a laser diode, a polygon mirror and a reflecting mirror. A transfer station E including a transfer roller is disposed at a position opposed to a photosensitive member 5*a* provided in the I/C 5.

A fixing unit 9 positioned to the rear of the paper outlet 3 is provided obliquely above and to the rear of the I/C 5.

Figure 14:
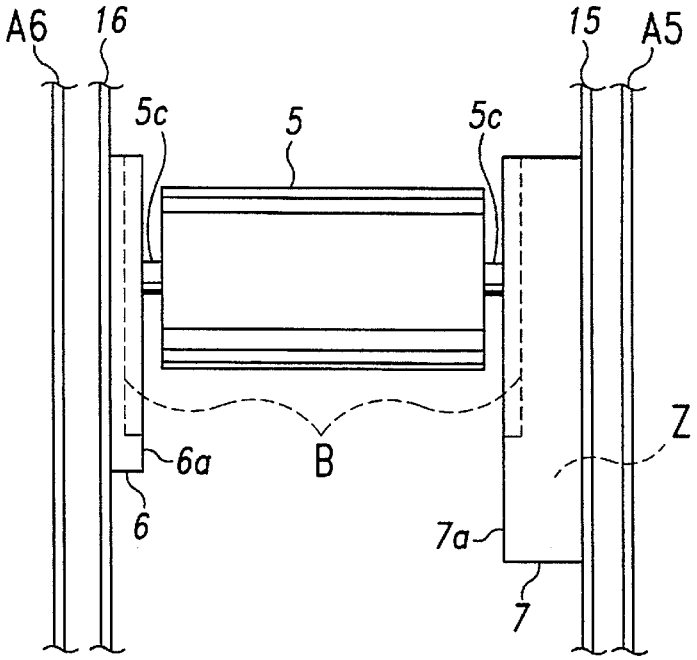
FIG. 14 is a schematic sectional view showing the relationship between side plate frames, the drive cover and an imaging cartridge holder.

As will be described hereinafter, a confined space region Z, shown in FIG. 14, is formed on the right side (front side of the plane of FIG. 4) of the feed station D and the I/C 5 within the body A, and a drive structure (also not shown in FIG. 4) comprising a gear group G is disposed in the region Z and is coupled to a drive source motor M.

Figure 9:
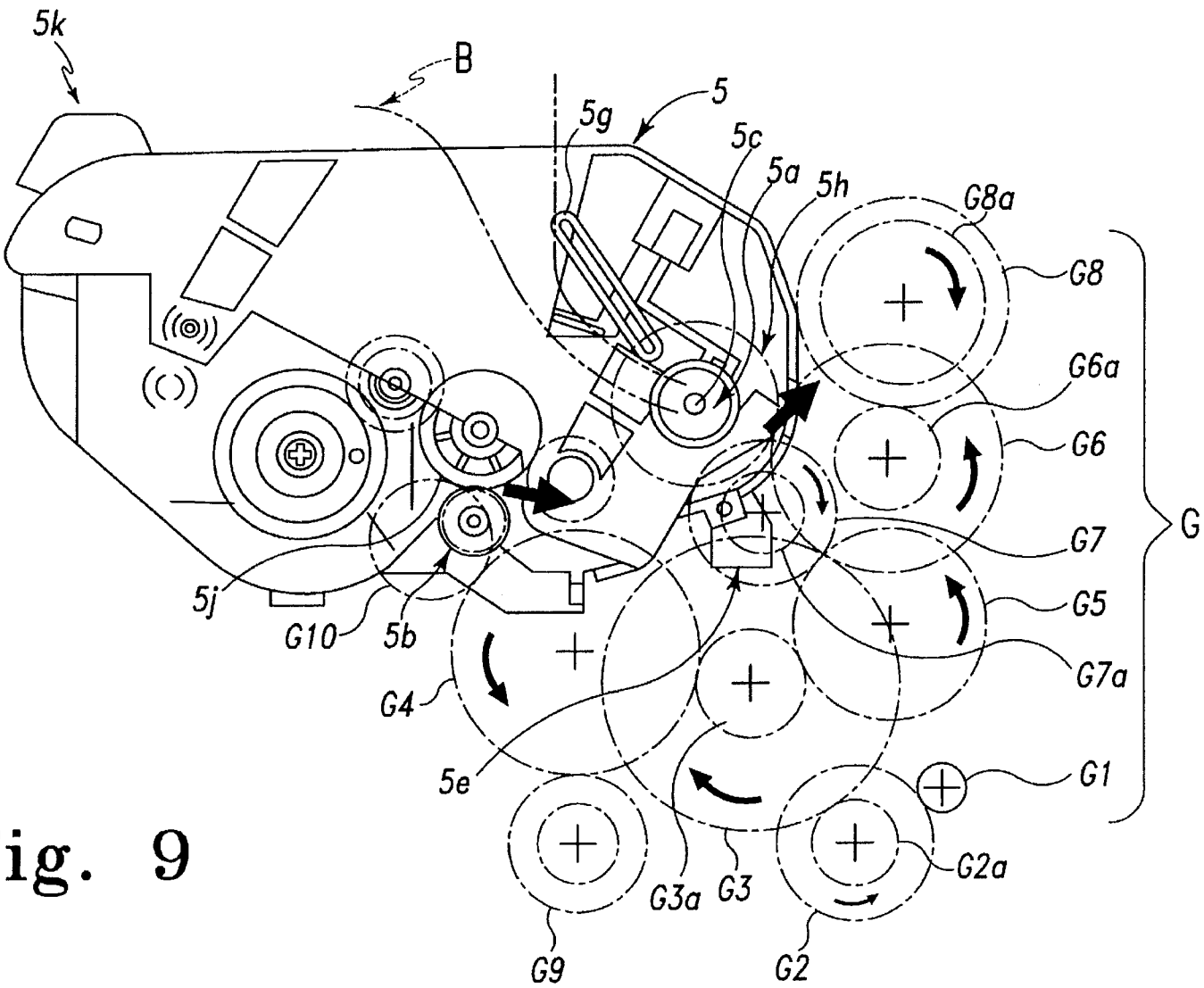
FIG. 9 is a side elevation schematically illustrating the operation of the gear train of FIG. 5.

The I/C 5 comprises a separately manufactured component which is installable into and removable from printer device 100. As shown in FIGS. 9 and 11, the I/C 5 is generally in the form of a pillow (see also FIG. 3) having the photosensitive member 5*a* and a developing unit 5*b* (see FIG. 4) housed therein. An engaging pin 5*c* projects outwardly from each side of the I/C 5 coaxially with the photosensitive member 5*a*, and is adapted to be engaged in a guide groove of a guide means B to be described hereinafter. A projection 5*e* is formed on the bottom of the I/C 5 for releasing a shutter 5*d* (see FIG. 11 ) for the photosensitive member 5*a* when the I/C 5 is positioned in place in the printer device 100.

A left-side front lower portion of the I/C 5, as installed, has a hook portion 5*f* engageable with a projection member 52 of a biasing means C to be described hereinafter. An engaging projecting portion 5*g* engageable in a guide groove of the guide means B is integrally formed on each outer side of the I/C 5 and is positioned obliquely above the engaging pin 5*c*. During installation into printer device 100, the I/C 5 to be installed is guided into position by the movement of the projecting portions 5*g* and the engaging pins 5*c* along the guide means B.

The photosensitive member 5*a* and the developing unit 5*b* are provided, each at its right end, with driven gears 5*h* and 5*j* for driving the respective components. When the I/C 5 is properly positioned in the printer device, the driven gears 5*h* and 5*j* mesh, respectively, with intermediate gears G7*a* and G10 to be described below to drive the photosensitive member 5*a* and the developing unit 5*b*.

The I/C 5 has a front upper projection serving as a handgrip 5*k* to facilitate the installation or removal thereof from the printer device 100.

Figure 5:
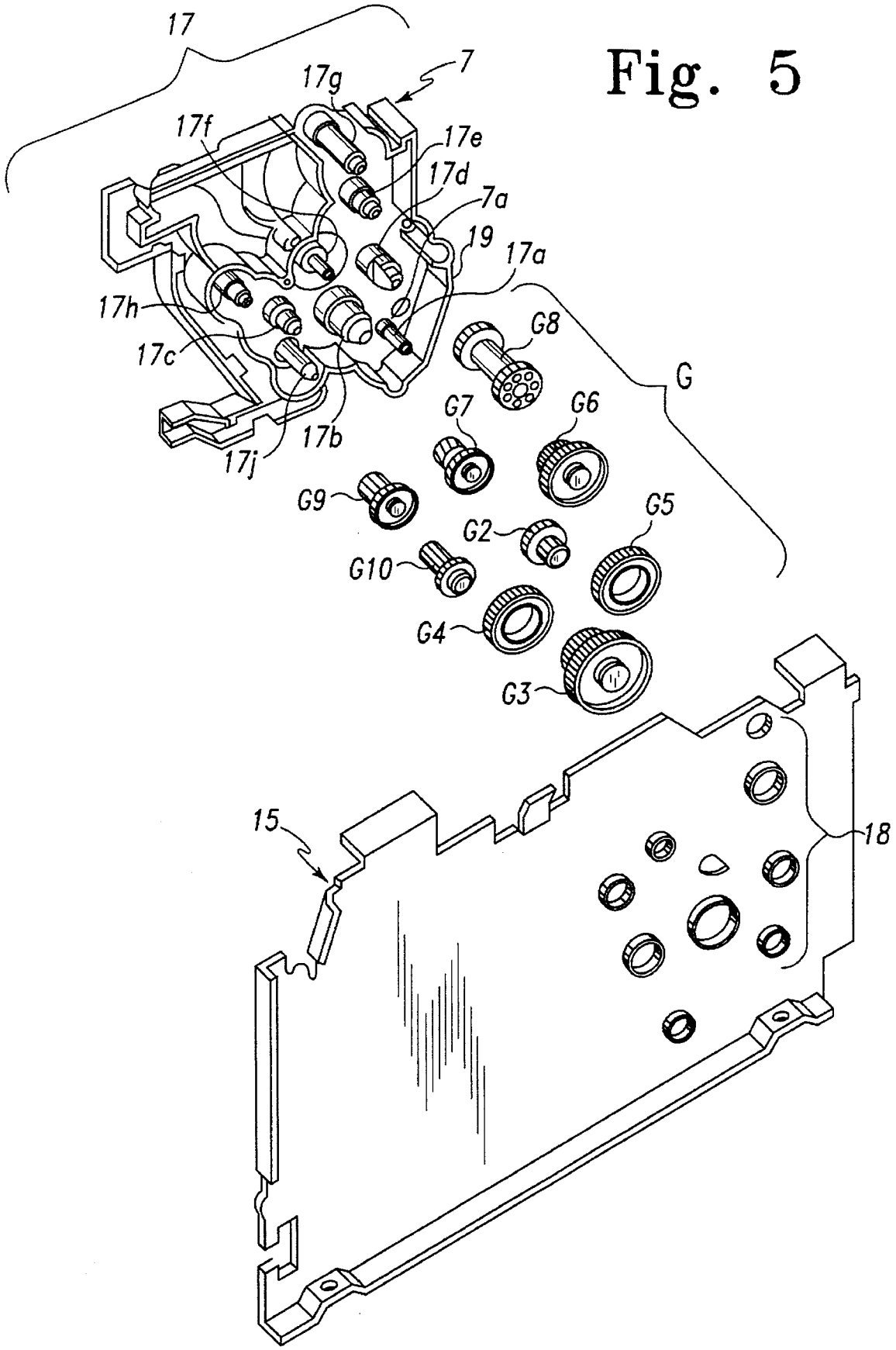
FIG. 5 is an exploded perspective view illustrating a group of gear shafts and a group of gears incorporated in a drive train of the printer device of FIG. 1.

A right side plate frame 15 is disposed inwardly of a right outer cover A5 of the device body A to provide a double structure to the right side portion of the body, and a drive cover 7 is disposed inwardly of the right side plate frame 15 in parallel thereto (see FIGS. 3 and 14). As shown in FIG. 5, positioned in matching relation with a group of gear shafts 17 which are arranged inside the drive cover 7 and which will be described below, are a group of burring holes 18 formed in the frame 15 to receive and support one of the ends of the respective shafts. Each of the group of shafts 17 is supported at their opposite ends by the drive cover 7.

As shown in FIG. 14, a left side plate frame 16 is disposed inwardly of a left outer cover A6 of device body A to provide a double structure to the left side portion of the body, and an imaging cartridge holder 6 (hereinafter "I/C holder 6") to be described hereinafter is fixed to the inner side of the frame 16 to position the I/C 5 between the I/C holder 6 and the drive cover 7 (also see FIG. 3).

The drive cover 7 is made entirely of a resin material and is fixed to the inner side of the right side plate frame 15.

As shown in FIG. 5, the drive cover 7 is integrally lo formed with a group of gear shafts 17 projecting outwardly from the inner surface of its main wall 7*a* for rotatably supporting the group of gears G. The outer ends of the gear shafts 17 are fittingly inserted into the respective burring holes 18 in the right side plate frame 15, whereby the shafts are supported at their opposite ends; and the two members 7 and 15 are also thereby positioned in place relative to each other.

Figure 6:
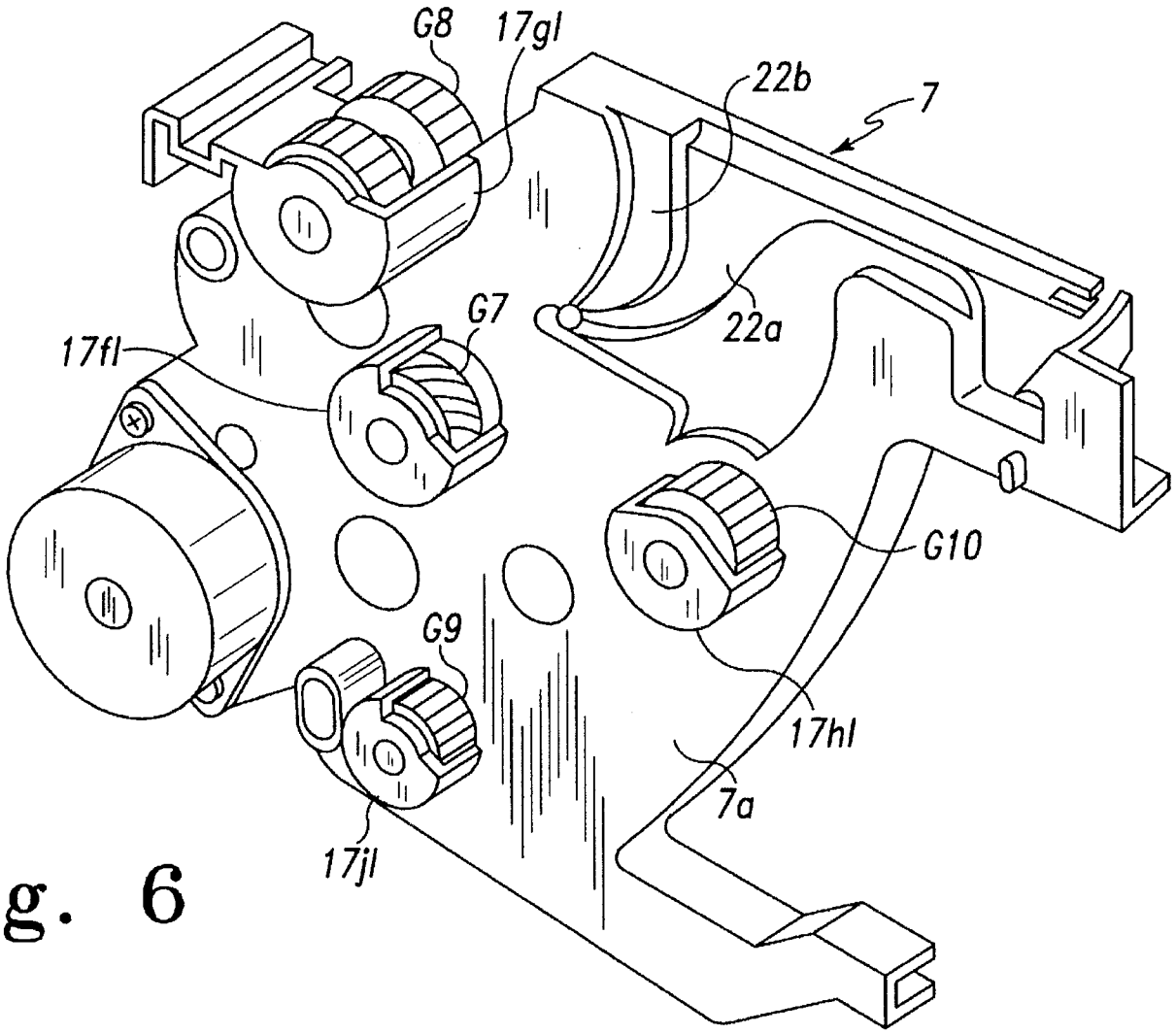
FIG. 6 is a perspective view of a drive cover as viewed from inside the body of the printer device of FIG. 1.

The drive cover 7 is formed along its periphery with a wall piece 19 having such a height as to accommodate the gear group G as shown in FIG. 5. The outer end of the peripheral wall piece 19 is in bearing contact with the inner surface of the right side plate frame 15 to define the confined space region Z between the inner surface of the right side plate frame 15 and the inner surface of the main wall 7*a* of the drive cover 7. The opposite, outer wall surface of the main wall 7*a* of the drive cover 7, shown in FIG. 6, is formed with guide grooves 22*a* and 22*b* which are of different depth and which serve as the guide means B for guiding the right side of the I/C 5 when the I/C 5 is installed or removed from the device 100. One of the engaging pins 5*c* of the I/C 5 engages in the deep groove 22*a*, and one of the engaging projecting portions 5*g* engages in the shallow groove 22*b*.

Figure 13B:
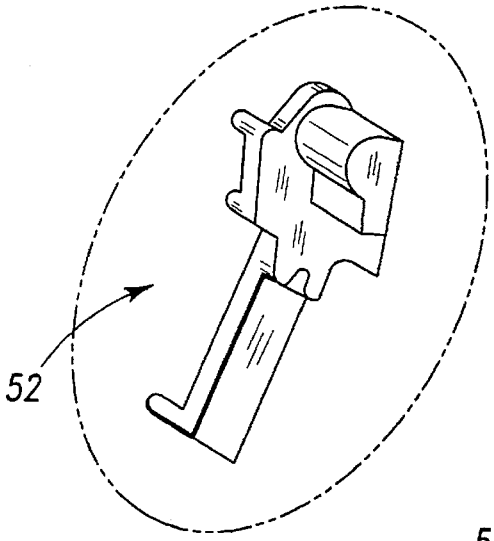
FIG. 13 is a perspective view of an imaging cartridge holder as viewed from inside the device body.
Figure 13A:
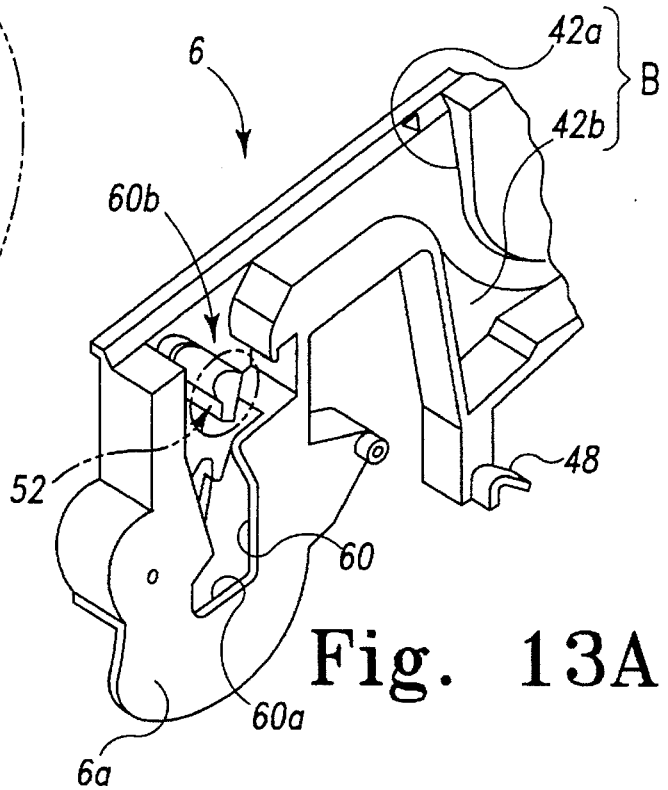

With reference to FIGS. 13 and 14, the I/C holder 6, which is fixed to the inner surface of the left side plate frame 16, has a surface in the main wall 6*a* thereof which is opposed to the drive cover 7 and which is formed with an engaging groove 60 for the hook portion 5*f* of the I/C 5 to engage in, and with guide grooves 42*a* and 42*b* serving as guide means B for the other of the engaging pins 5*c* and the other of the projecting portions 5*g* of the I/C 5 to engage in. The guide groove 42*a* is deep while the guide groove 42*b* is shallow. The pin 5*c* engages in guide groove 42*a*, and the projecting portion 5*g* engages in guide groove 42*b*. The guide means B on the I/C holder 6 is exactly symmetrical with the guide means B on the drive cover 7 and guides the left side of the I/C 5.

The I/C holder 6 is formed with an inverted L-shaped contact member 48 projecting inwardly at a lower portion of its inner side. The shutter 5*d* protecting the photosensitive member 5*a* is opened by the contact member 48 coming into contact with the projection 5*e* on the I/C 5 when the I/C 5 is inserted.

On the other hand, a biasing means C is provided on the rear side of the I/C holder 6, i.e., between the holder and the left side frame 16.

Figure 12:
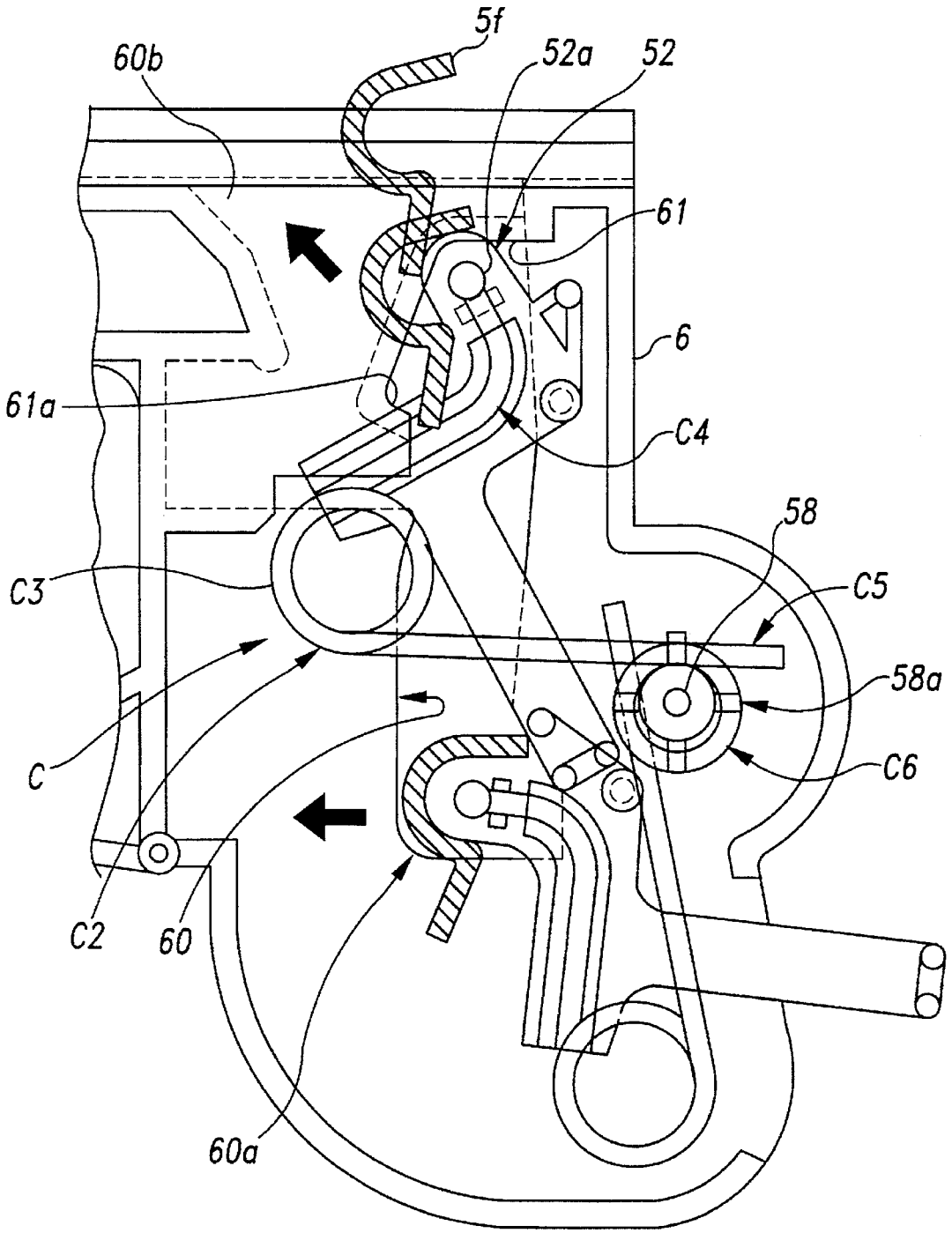
FIG. 12 is a side sectional view illustrating a biasing means incorporated in the printer device of FIG. 1.

Referring to FIG. 12, the biasing means C comprises a coiled torsion spring C2 serving as a resilient member, a support pin 58 for rotatably supporting the base portion of the spring C2 and projection member 52 engageable with hook portion 5*f* of the I/C 5. The I/C 5 is positioned in place by the biasing action of the coiled torsion spring C2.

More specifically, the torsion spring C2 comprises a pressure accumulating coil portion (i.e., a coil portion C3) for producing a biasing force, an acting arm C4 extending from the coil portion C3 in one direction and a support arm C5 extending from the coil portion C3 in another direction as shown in FIG. 12. The acting arm C4 has a bent end which is secured to the projection member 52. The support arm C5 is integrally formed at its base portion with an annular support C6 for pivotal movement. The annular support C6 is loosely fitted around the support pin 58. When inserted, the I/C 5 deforms the coil portion C3 of the torsion spring C2 to change the biasing direction thereof to reliably position the I/C 5 in place. The group of operatively related gears G are generally accommodated in the confined space region Z defined by the drive cover 7 and the right side plate frame 15.

More specifically, the gear group G comprises nine intermediate gears G2 to G10 and a single drive gear G1, providing a gear train wherein, as shown in detail in FIGS. 5 and 9, a torque is transmitted from the drive gear G1 to the intermediate gears G2 to G10 meshing with one another for rotation and then to the driven gears 5*h* and 5*j* on I/C 5.

It should be understood that the illustrated gear train is exemplary only and can be readily modified as desired as is well-known to those skilled in the art.

The drive gear G1 is fixed to the drive shaft of motor M (FIG. 4) which is attached to the body side of the drive cover 7 and serves as a drive source. The gear G1 is inserted into the confined space region Z through a hole 7*a* in the drive cover 7 and meshes with the intermediate gear G3 idly rotatably supported on a gear shaft 17*a*.

The intermediate gear G3 comprises a large gear which meshes with intermediate gear G6 which is idly rotatably mounted on a gear shaft 17*e*, and a small gear G3*a* which meshes with both the intermediate gears G4 and G5 which are freely rotatably mounted on gear shafts 17*c* and 17*d*, respectively, for dividedly transmitting the torque.

The intermediate gear G4 meshes with the intermediate gear G9 which is freely rotatably mounted on a gear shaft 17*j* and causes the gear G10 to rotate the driven gear 5*j* on the I/C 5 counterclockwise to drive the developing unit 5*b*.

On the other hand, the intermediate gear G5 meshes with the intermediate gear G7 which is idly rotatably mounted on a gear shaft 17*f*, causing a small gear G7*a* to rotate the driven gear 5*h* on the I/C 5 counterclockwise to drive the photosensitive member 5*a*.

The intermediate gear G6 includes a small gear G6*a* meshing with the intermediate gear G8 which is idly rotatably mounted on a gear shaft 17*g* to cause a small gear G8*a* of the gear G8 to drive the fixing unit 9 counterclockwise.

The intermediate gear G4, which also meshes with the intermediate gear G9 idly rotatably mounted on the gear shaft 17*j* therebelow, causes the gear G9 to drive the feed roller (not shown) of the feed station D in the direction of feed of a sheet of paper P.

Figure 7:
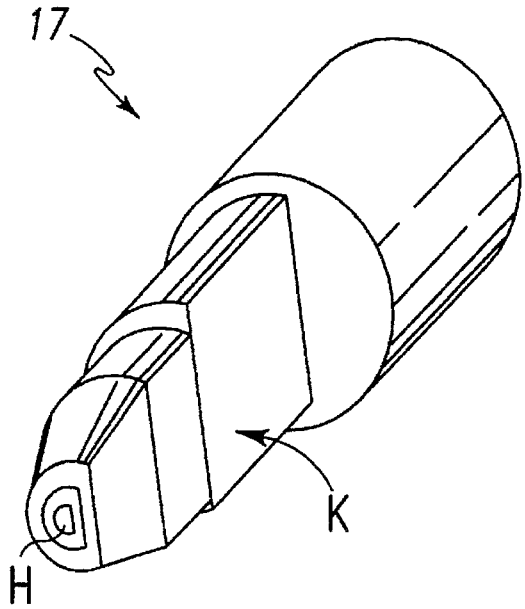
FIG. 7 is a perspective view illustrating the construction of a gear shaft of the gear train of FIG. 5.
Figure 8:
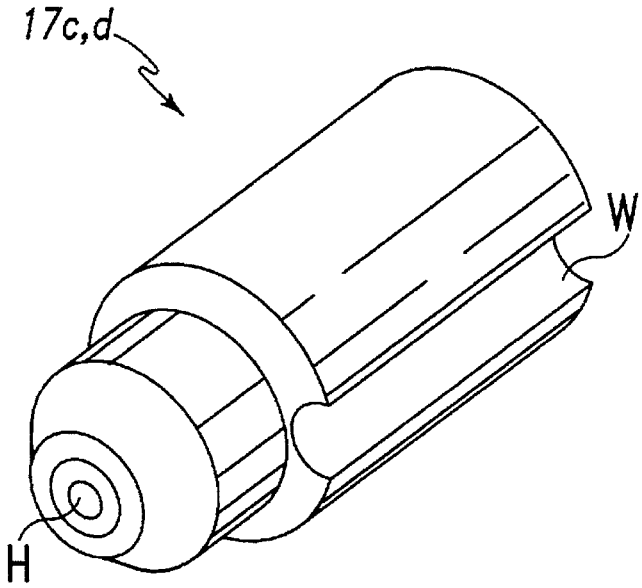
FIG. 8 is a perspective view illustrating the construction of another gear shaft of the gear train of FIG. 5.

As seen in FIGS. 7 and 8, each of the gear shafts 17*a* to 17*j* supporting the respective gears of gear group G has a bore H extending axially therethrough so as to function as a duct for providing communication between the interior of the device body A and the outside so as to pass air therethrough when the drive cover 7 is joined to the right side plate frame 15.

Furthermore, the outer peripheries of specified gear shafts 17*c* and 17*d* included in the shaft group 17 are cut out along their axial direction as shown at K in FIG. 8 to make the shafts noncircular in cross-section to thereby avoid interference between the outer peripheries of the pair of shafts and gears adjacent to the shafts. This makes it possible to advantageously control the axis-to-axis distance (center distance) between the pair of shafts which is inevitably limited in determining the direction of rotation and the number of revolutions of the pair of gears on the respective shafts.

Each of the shafts which idly rotatably support respective gears G thereon has a grease groove W parallel to the axial direction in its surface which is slidably in contact with the supported gear (see FIG. 7). The groove W is shaped to alleviate troubles due to sliding friction between the shaft and the gear.

Next, a description will be given of the operation of the embodiment of the printer device 100 described above.

Paper P is fed to the printer device 100 after opening the front cover 1 and with the I/C 5 installed in position within the device body A as shown in FIG. 4. The paper P is fed to the feed station D and is subjected to a known process by the I/C 5 having the photosensitive member 5*a* and the developing unit 5*b*, the transfer station E, the fixing unit 9, etc. for image formation. The resulting paper P1 having an image formed thereon is discharged from the paper outlet 3 onto the discharge tray 2.

More specifically, the front cover 1 of the device body A is first opened in the direction of arrow R3 in FIG. 2 and is thereby enabled to function as a feed tray for the paper P.

Next, the paper discharge tray 2 provided on the upper cover 4 is opened in the direction of arrow R2, and paper P is placed on the rear side of the front cover 1 serving as the feed tray.

The operation panel A1 is thereafter manipulated to set a specified mode and to turn on the start switch, whereby the printer device 100 is initiated into operation.

With the start of operation, the drive source motor M is driven via the high-voltage board 13, and the train of gears G is rotated in operative relation with the motor M.

More specifically, and with reference to FIG. 9, the drive gear G1 rotates clockwise to rotate the intermediate gear G2 in meshing engagement therewith counterclockwise.

The gear G2 causes small gear G2*a* thereof to rotate the intermediate gear G3 clockwise. The gear G3 rotates the intermediate gears G4 and G5 counterclockwise at the same time by the small gear G3*a* thereof which meshes with both of the gears G4 and G5.

The gear G4 rotates the intermediate gear G9 clockwise by meshing engagement therewith, driving the feed means D for the transport of paper P; and, at the same time, also meshes with the intermediate gear G10 to rotate the driven gear 5*j* of the I/C 5 which meshes with the gear G10 counterclockwise to drive the developing unit 5*b*.

On the other hand, the gear G5 rotates the intermediate gear G7 clockwise, causing the small gear G7*a* of the gear G7 to drive the photosensitive member 5*a* counterclockwise by meshing engagement with the driven gear 5*h* on the I/C 5.

Furthermore, the intermediate gear G3, which is also in mesh with the intermediate gear G6, rotates the gear G6 counterclockwise, causing the small gear G6*a* of the gear G6 to rotate the intermediate gear G8 clockwise to drive the fixing unit 9 by the small gear G8*a* thereof.

Since the group of gears G are in mesh at all times, the feed means D, the photosensitive member 5*a*, the developing unit 5*b*, the fixing unit 9, the paper discharge roller (not shown), etc. can all be reliably driven in synchronism at specified times by virtue of definite speed ratios based on predetermined teeth numbers of the various gears.

Further, concurrently with the above operation, the electrical functions of the printer device 100 including the optical head 8, etc. are effected by the controller :31 comprising the low-voltage board.

In the present invention, the group of shafts 17 supporting the gear group G are integral with the resin drive cover 7. This assures uniform axis-to-axis distances of the shafts. Furthermore, the gear group G is accommodated in the confined space region Z which is formed between the main wall 7*a* of the drive cover and the right side plate frame 15, and within the peripheral wall piece 19 of the drive cover. This eliminates the likelihood that meshing noises of the gear group G will escape to the outside of the printer device 100, consequently assuring a substantially silent operation of the printer device. As shown in FIG. 6, gears G7, G8, G9 and G10, which are positioned inside the device body A inwardly of the main wall 7*a* of the drive cover 7, are provided with covers 17*f*1, 17*g*1, 17*j*1 and 17*h*1, respectively, except at their meshing portions, so that those gears are also effectively silenced.

Figure 10:
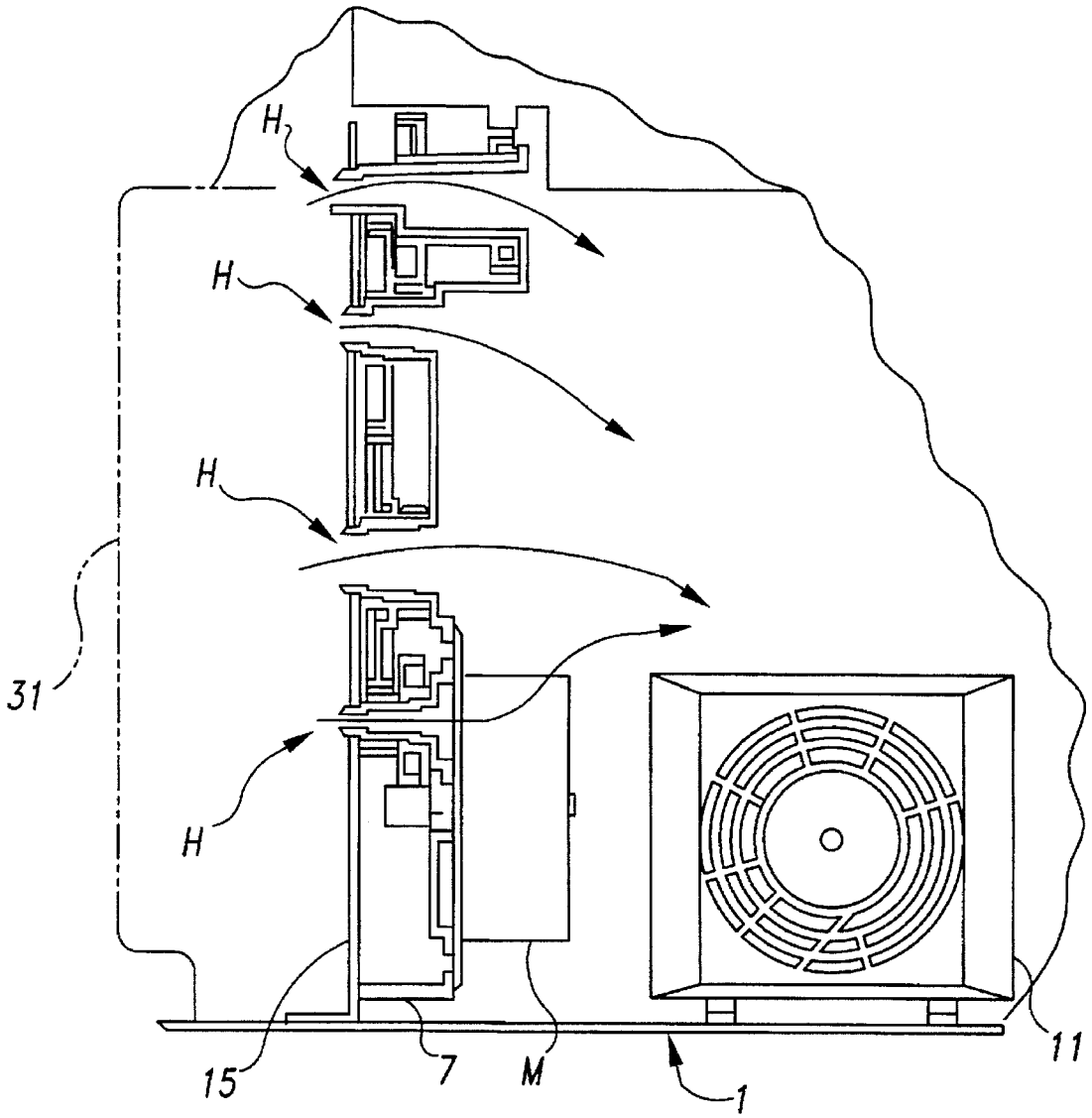
FIG. 10 is a fragmentary side elevation in section showing the printer device of FIG. 1 as viewed from the rear side thereof.

Additionally, the shafts 17 are each formed with the bore H extending axially therethrough, whereby heat produced by the controller 31 or the motor M inside the body A can be forcibly released to the outside through the bores H by the suction of the cooling fan 11 as illustrated in FIG. 10. This prevents degradation of the images formed on the paper P due to variations (rise) in temperature due to retained heat.

Moreover, the group of shafts 17 are fittingly inserted into respective burring holes 18 formed in the right side plate frame 15. This makes it possible to reliably support the shafts 17 at their free ends, obviating the likelihood that the repelling force of meshing gears will move the free ends of the shafts away from each other if they are supported in a cantilever fashion, and consequently eliminates irregular variations in the degree of backlashing of meshing gears. The grease groove W formed in each shaft, as shown in FIG. 7, further mitigates against resistance to the sliding contact between the inner periphery of the supported gear and the outer periphery of the shaft, thus substantially eliminating meshing noise of gears or irregularities in rotation (delayed rotation due to an increased backlash) to further help provide images of good quality free from the influence of pitch irregularities.

Furthermore, shafts 17*c* and 17*d* have their outer peripheries cut out to a noncircular form as indicated at K in FIG. 8, thereby preventing the intermediate gear G3 from interfering with the outer peripheries of the two shafts 17*c* and 17*d* and reducing the axis-to-axis distance (center distance) between the two shafts 17*c* and 17*d* to a minimum, so that the gear train can be laid out in a compact manner. This contributes significantly to the overall compactness of the device body A.

The manner in which the I/C 5 is installed in or removed from the printer device 100 will be described next.

There arises a need to occasionally remove the I/C 5 from printer device 100 for maintenance purposes, for example, when the developing unit 5*b* has been depleted of toner, when the surface of the photosensitive member 5*a* has been soiled or in the event of a paper jam occurring while the printer device is in use.

The upper cover 4 of the body A is first opened upward to open the upper side of the device body A, and the I/C 5 is removed through the opened portion.

With reference to FIG. 11, when the I/C 5 is to be installed, the engaging pins 5*c* projecting from the opposite outer sides of the photosensitive member 5*a* in the I/C 5 are engaged in the deep grooves 22*a*, 42*a* of the guide means B provided, respectively, in the drive cover 5 and the I/C holder 6, the hook portion 5*f* of the I/C 5 shown in FIG. 12 is engaged with the engaging projection member 52 of the biasing means C, and the I/C 5 is thereafter inserted into the device body by hand. During insertion, the I/C 5 is moved downward with the pins 5*c* engaged in the deep grooves 22*a*, 47*a* of the guide means B and with the projecting portions 5*g* engaged in the shallow grooves 22*b*, 42*b* for guiding. The engagement of the hook portion 5*f* with the projection member 52 releases a pin 52*a* from engagement with an upper wall 61, and the projection member 52 descends along the groove 60 to groove portion 60*a* while changing the biasing direction of the coiled torsion spring C2 against the biasing force thereof as shown in FIG. 12. Upon reaching its final position, the I/C 5 is positioned for use. The I/C 5 is held in this position with good stability by the torsion spring C2 having its biasing direction changed from upward to downward.

The I/C 5 is brought to its final position with a click, which is perceivable by hand for recognition. More specifically, before the I/C 5 is inserted, the support arm of the torsion spring C2 has its annular support C6 supported by the pin 58, with the acting arm C4 biasing the pin 52*a* of the projection member 52 into engagement with the upper wall 61 . During insertion of the I/C 5, the hook portion 5*f* engages with the projection member 52 and pivotally moves the torsion spring C2 about the support pin 58 to disengage the pin 52*a* from the upper wall 61 at a stepped wall portion 61*a*. The projection member 52 moves downward along the groove 60 while changing its orientation.

This changes the biasing direction of the torsion spring C2 through about 90 degrees while increasing the deformation of its pressure accumulating portion C3 to give an increased biasing force. The spring therefore presses the projection member 52 against a side wall at the final position, whereby the I/C 5 is properly positioned in place.

The I/C 5 is removed from the device body A through exactly the reverse of the foregoing installation movement.

Immediately before the I/C 5 is positioned in place, the projection 5*e* at the lower portion of the I/C 5, comes into contact with the contact member 48 of the I/C holder 6, whereby the shutter 5*d* protecting the photosensitive member 5*a* is opened to ready the photosensitive member 5*a* for exposure.

Further, and as indicated above, when the I/C 5 is inserted, the user's hand inserting the I/C 5 will perceive the resulting click, so that complete and proper insertion of the I/C 5 can be readily recognized.

As described above, the printer device 100 of the present invention includes a confined space region which is provided inside the device body A in which gears of the gear group G can be accommodated. The printer device 100, therefore, has the advantage of being effectively silenced both inside and outside of the device body A.

Although the present invention has been described in detail with reference to a presently preferred embodiment thereof, it should be recognized that variations and modifications exist within the scope and spirit of the invention. Accordingly, it should be understood that the invention is to be limited only insofar as is required by the scope of the following claims.

I claim:

1. An image forming device comprising:

a device body having a contour generally in the form of a box;

a pair of side plate frames provided inside said device body;

an imaging cartridge removably installable in the device body between the pair of side plate frames and having a driven element and a driven gear which transmits a drive force to said driven element;

a plurality of intermediate gears provided in the device body, at least one of said plurality of intermediate gears meshing with said driven gear for transmitting a drive force to said driven gear;

a drive gear connected to a motor for driving said at least one of said plurality of intermediate gears; and a cover provided inside said device body and disposed inwardly of one of said pair of side plate frames in parallel thereto and joined to said one of said pair of side plate frames to define a confined space region between said cover and said one of said pair of side plate frames, said drive gear being disposed in said confined space region.

2. An image forming device as claimed in claim 1, wherein said driven element comprises a photosensitive member.

3. An image forming device as claimed in claim 1, wherein said driven element comprises a developing unit.

4. An image forming device as claimed in claim 1, wherein said plurality of intermediate gears are also disposed in said confined space region.

5. An image forming device as claimed in claim 4, wherein said cover includes a plurality of integrally formed gear shafts projecting from an inner surface of said cover for rotatably supporting said plurality of intermediate gears.

6. An image forming device as claimed in claim 5, wherein each of said shafts has a grease groove parallel to the axial direction in its surface.

7. An image forming device as claimed in claim 1, wherein said cover includes an integrally formed groove which guides said imaging cartridge.

8. An image forming device comprising:

a device body having a contour generally in the form of a box;

a pair of side plate frames provided inside said device body;

an imaging cartridge removably installable in the device body between the pair of side plate frames and having a driven element and a driven gear which transmits a drive force to said driven element;

a plurality of intermediate gears provided in the device body,. at least one of said plurality of intermediate gears meshing with said driven gear for transmitting a drive force to said driven gear;

a drive gear connected to a motor for driving at least one of said plurality of intermediate gears; and a cover provided inside said device body and disposed inwardly of one of said pair of side plate frames in parallel thereto and joined to said one of said pair of side plate frames to define a confined space region between said cover and said one of said pair of side plate frames, said drive gear and said plurality of intermediate gears being disposed in said confined space region, and said cover including a plurality of integrally formed gear shafts projecting from an inner surface of said cover for rotatably supporting said plurality of intermediate gears;

wherein said one of said pair of side plate frames includes a plurality of holes, and wherein a projecting end of each of said plurality of gear shafts is inserted in a respective one of said plurality of holes so that each of the plurality of gear shafts is supported at its opposite ends.

9. An image forming device as claimed in claim 8, wherein each of the plurality of gear shafts has a bore extending axially therethrough so that an interior space of said device body between said pair of side plate frames is in communication with spaces exterior of said pair of side plate frames through said bores.

10. An image forming apparatus comprising:

an imaging cartridge removably installable in a body of the image forming apparatus and having a driven element housed therein;

a driven gear provided on the cartridge for transmitting a drive force to said driven element;

a plurality of intermediate gears provided in the body of the image forming apparatus, at least one of said plurality of intermediate gears meshing with said driven gear when the imaging cartridge is installed in the body of the image forming apparatus;

a drive gear which meshes with the at least one of the plurality of intermediate gears for driving the at least one intermediate gear;

a motor connected to the drive gear to drive the drive gear;

a side plate frame provided in the body of the image forming apparatus; and a cover provided inside the body of the image forming apparatus and disposed inwardly of said side plate frame in parallel thereto and joined to said side plate frame to define a confined space region between said cover and said side plate frame, said drive gear being disposed in the confined space region.

11. An image forming apparatus as claimed in claim 10, wherein said driven element comprises a photosensitive member.

12. An image forming apparatus as claimed in claim 10, wherein said driven element comprises a developing unit.

13. An image forming apparatus as claimed in claim 10, wherein said plurality of intermediate gears are also disposed in said confined space region.

14. An image forming apparatus as claimed in claim 13, wherein said cover includes a plurality of integrally formed gear shafts projecting from an inner surface of said cover for rotatably supporting said plurality of intermediate gears.

15. An image forming apparatus as claimed in claim 14, wherein each of said shafts has a grease groove parallel to the axial direction in its surface.

16. An image forming apparatus as claimed in claim 10, wherein said cover includes an integrally formed groove which guides said imaging cartridge.

17. An image forming apparatus comprising:

an imaging cartridge removably installable in a body of the image forming apparatus and having a driven element housed therein;

a driven gear provided on the cartridge for transmitting a drive force to said driven element;

a plurality of intermediate gears provided in the body of the image forming apparatus, at least one of said plurality of intermediate gears meshing with said driven gear when the imaging cartridge is installed in the body of the image forming apparatus;

a drive gear which meshes with the at least one of the plurality of intermediate gears for driving the at least one intermediate gear;

a motor connected to the drive gear to drive the drive gear;

a side plate frame provided in the body of the image forming apparatus; and a cover provided in the body of the image forming apparatus and joined to said side plate frame to define a confined space region between said cover and said side plate frame, said drive gear and said plurality of intermediate gears being disposed in the confined space region, and said cover including a plurality of integrally formed gear shafts projecting from an inner surface of said cover for rotatably supporting said plurality of intermediate gears;

wherein said side plate frame includes a plurality of holes, and wherein a projecting end of each of said plurality of gear shafts is inserted in a respective one of said plurality of holes so that each of the plurality of shafts is supported at its opposite ends.

18. An image forming apparatus as claimed in claim 17 wherein each of the plurality of gear shafts has a bore extending axially therethrough so that opposed sides of said side plate frame are in communication through said bores.

19. An image forming device comprising:

a device body;

an imaging cartridge removably installable within the device body and having a driven element and a driven gear which transmits a drive force to the driven element;

a plurality of intermediate gears provided inside the device body, at least one of said plurality of intermediate gears meshing with said driven gear to drive said driven gear;

a drive gear provided inside the device body to drive said at least one of said plurality of intermediate gears;

a frame member provided inside said device body; and a cover member provided inside said device body and disposed inwardly of said frame member in parallel thereto and attached to said frame member to define a confined space region between said cover member and said frame member, said drive gear being disposed in said confined space region.

20. The image forming device of claim 19 wherein said driven element comprises a photosensitive member.

21. The image forming device of claim 19 wherein said driven element comprises a developing unit.

22. The image forming device of claim 19 wherein said plurality of intermediate gears are also disposed in said confined space region.

23. An image forming device as claimed in claim 19, wherein said cover member includes an integrally formed groove which guides said imaging cartridge.

24. An image forming apparatus comprising:

an imaging cartridge removably installable in a body of the image forming apparatus and having a driven element housed therein;

a driven gear provided on the cartridge for transmitting a drive force to said driven element;

a plurality of intermediate gears provided in the body of the image forming apparatus, at least one of said plurality of intermediate gears meshing with said driven gear when the imaging cartridge is installed in the body of the image forming apparatus;

a drive gear which meshes with the at least one of the plurality of intermediate gears for driving the at least one intermediate gear;

a motor connected to the drive gear to drive the drive gear;

a side plate frame provided in the body of the image forming apparatus; and a cover provided in the body of the image forming apparatus and disposed inwardly of said side plate frame in parallel thereto and joined to said side plate frame to define a confined space region between said cover and said side plate frame, said drive gear being disposed in the confined space region;

wherein said intermediate gear which is meshed with said driven gear of the imaging cartridge projects from said cover in an opposite direction to said side plate frame.

25. An image forming apparatus as claimed in claim 24, further comprising an auxiliary cover provided with said projecting intermediate gear except at a meshing portion thereof.

26. An image forming apparatus as claimed in claim 25, wherein said auxiliary cover is integrally formed with said cover.

27. An image forming apparatus as claimed in claim 24, wherein said cover includes a plurality of integrally formed gear shafts projecting from an inner surface of said cover for rotatably supporting said plurality of intermediate gears and an integrally formed groove which guides said imaging cartridge.

28. An image forming apparatus as claimed in claim 27, wherein each of said shafts has a grease groove parallel to the axial direction in its surface.

* * * * *